US007779598B2

(12) United States Patent
Daas et al.

(10) Patent No.: US 7,779,598 B2
(45) Date of Patent: Aug. 24, 2010

(54) LATTICE SUPPORT STRUCTURE

(75) Inventors: Kamal Daas, Bergschenhoek (NL); Doron Livnat, Oostvoorne (NL)

(73) Assignee: Prodelta Investments B.V., Spijkenisse (NL)

( * ) Notice: Subject to any disclaimer, the term of this patent is extended or adjusted under 35 U.S.C. 154(b) by 347 days.

(21) Appl. No.: 11/664,068

(22) PCT Filed: Sep. 27, 2005

(86) PCT No.: PCT/EP2005/010437

§ 371 (c)(1),
(2), (4) Date: Apr. 9, 2008

(87) PCT Pub. No.: WO2006/034847

PCT Pub. Date: Apr. 6, 2006

(65) Prior Publication Data

US 2008/0302056 A1 Dec. 11, 2008

(30) Foreign Application Priority Data

Sep. 28, 2004 (DE) ..... 20 2004 015 072 U

(51) Int. Cl.
*E04B 1/19* (2006.01)
*E04B 1/344* (2006.01)
*E04C 3/00* (2006.01)

(52) U.S. Cl. ..... 52/646; 52/79.5; 52/DIG. 10

(58) Field of Classification Search ..... 52/646, 52/632, 109, 651.07, 581, DIG. 10, 79.5, 52/650.1, 652.1
See application file for complete search history.

(56) References Cited

U.S. PATENT DOCUMENTS

| | | | | | |
|---|---|---|---|---|---|
| 4,089,147 | A | * | 5/1978 | Bain | 52/632 |
| 4,259,790 | A | * | 4/1981 | Borisof | 434/83 |
| 4,274,222 | A | * | 6/1981 | Zahn et al. | 446/126 |
| 4,473,986 | A | | 10/1984 | Zeigler et al. | |
| 4,539,786 | A | | 9/1985 | Nelson et al. | |
| 4,722,162 | A | * | 2/1988 | Wilensky | 52/652.1 |
| 4,761,929 | A | * | 8/1988 | Zeigler | 52/646 |
| 4,765,114 | A | * | 8/1988 | Wesselski | 52/646 |
| 4,791,761 | A | | 12/1988 | Goudie et al. | |

FOREIGN PATENT DOCUMENTS

| | | | |
|---|---|---|---|
| CH | 690 927 | A5 | 2/2001 |
| DE | 259 651 | A1 | 8/1988 |
| EP | 0 884 425 | A | 12/1998 |

* cited by examiner

*Primary Examiner*—Robert J Canfield
(74) *Attorney, Agent, or Firm*—Carter, DeLuca, Farrell & Schmidt, LLP

(57) ABSTRACT

The invention relates to a lattice support structure comprising lattice rods interconnected in an articulated manner, wherein, in accordance with the invention, a first structure having small cross-sections extending constantly over its length can be spread apart into a truncated double pyramid structure which tapers toward its ends, with a plurality of first structures being able to be joined together and with the joined together first structures being able to be interconnected by lattice rods to form a second structure, with the additional lattice rods engaging at corner points of the spread-apart cross-sections.

4 Claims, 6 Drawing Sheets

LATTICE SUPPORT STRUCTURE

CROSS REFERENCE TO RELATED APPLICATIONS

Figure 1:
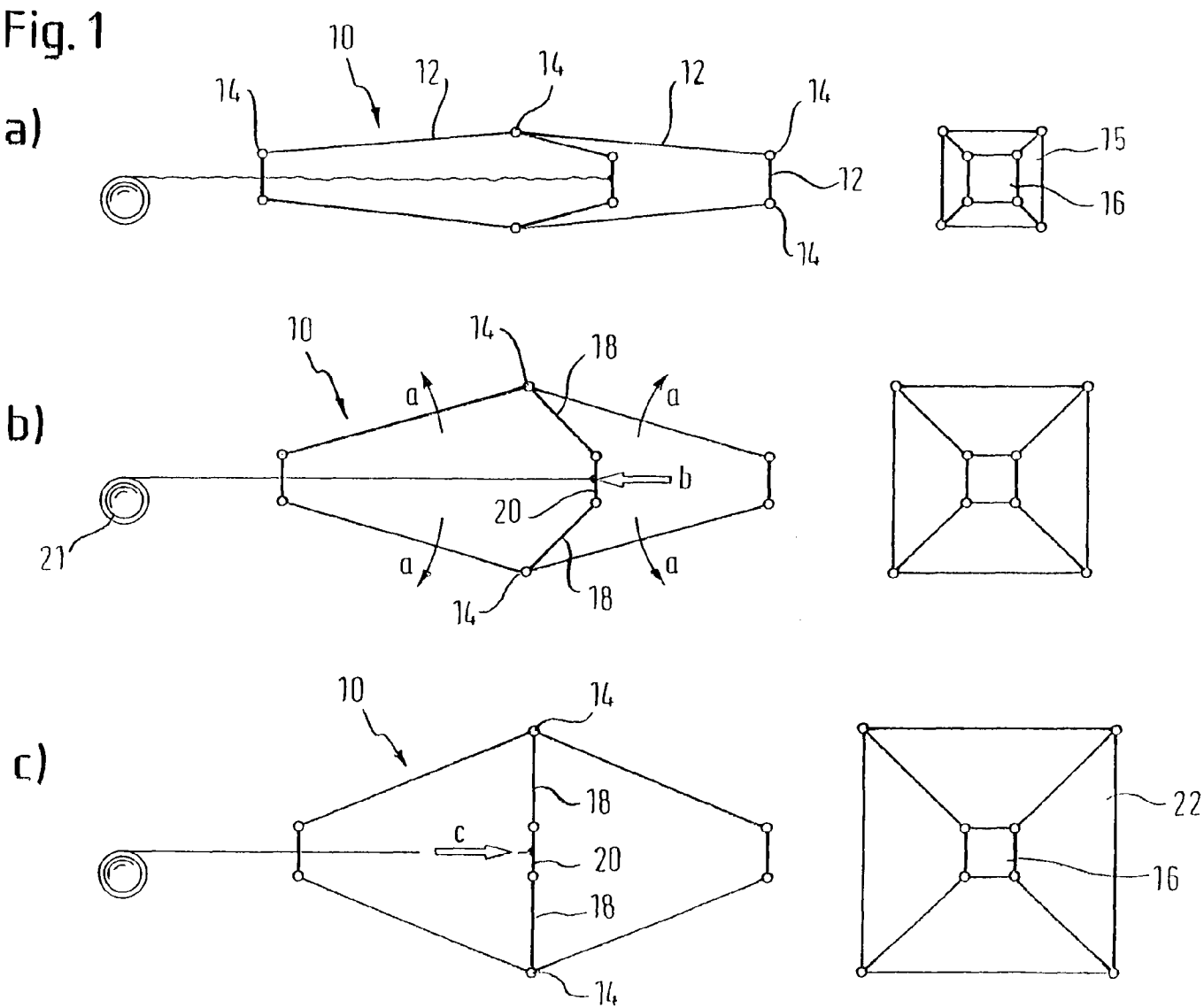

The present application claims the benefit of and priority to International Application No. PCT/EP2005/010437 filed Sep. 27, 2005, claiming priority from German Utility Model (Application) No. 20 2004 015 072.7 filed Sep. 28, 2004, the entire contents of each of which are incorporated herein by reference.

The invention relates to a lattice support structure comprising lattice rods interconnected in an articulated manner.

Lattice support structures are used, for example, in constructions which only have to be assembled for a temporary time and which have to be disassembled again for transport. It is disadvantageous, in particular on transport, that the individual members of the lattice support structures take up a very large amount of transport space since they have large cross-sections.

It is the object of the invention to provide a lattice structure for lattice support structures which can be transported in a smaller space. The high transport volume in the shipping of such lattice support structures should thus be minimized.

In accordance with the invention, a lattice support structure comprising lattice rods interconnected in an articulated manner is adapted to solve the aforesaid object in accordance with the combination of the features of claim 1. Accordingly, a first structure having a small cross-section which represents the transport position and which extends in constant manner over the length of said structure can be spread apart into a truncated double pyramid structure which tapers toward its ends, with a plurality of these first structures being able to be joined together and with the joined together first structures being able to be interconnected by lattice rods to form a second final structure, with the additional lattice rods engaging at the corner points of the spread apart cross-sections.

The lattice support structure can thus be converted from a first reduced cross-sectional size for the transport position into an enlarged cross-sectional size in the functional position, with the enlarged cross-section corresponding to the spread apart cross-section of the structure interconnected in an articulated manner. After a corresponding deployment of the first structure, the respectively spread apart cross-sections are interconnected at the periphery and longitudinally to the total structure by corresponding lattice rods so that a rigid lattice support structure results which has the required stability for the functional position.

Preferred aspects of the invention result from the dependent claims following on from the main claim.

Accordingly, the lattice support structure can have a triangular or rectangular cross-section. The cross-section is, however, preferably square.

Struts are present in the region of the cross-sections which can be spread apart which are preferably interconnected in an articulated manner and via which the cross-sections which can be spread apart can be spread apart or folded together.

The struts interconnected in an articulated manner can comprise a core region which corresponds to the small cross-section of the folded together first structure.

Articulated struts extend from the corners of these core regions to the corners of the cross-sections which can be spread apart.

Figure 2:
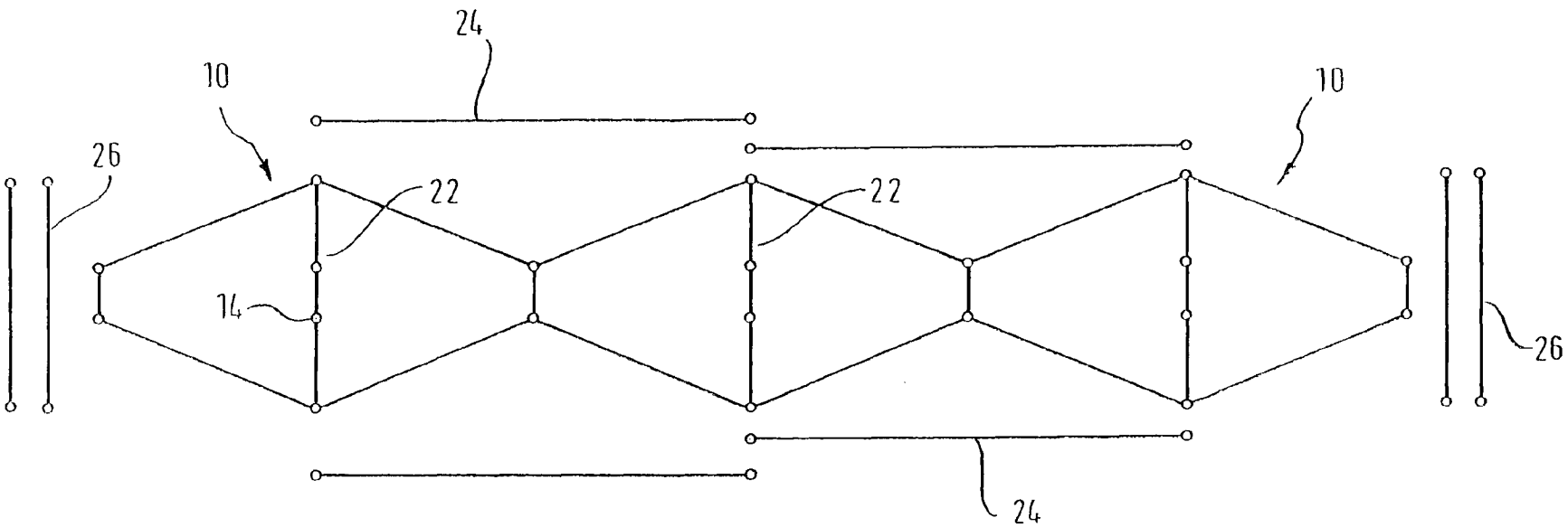
Figure 3:
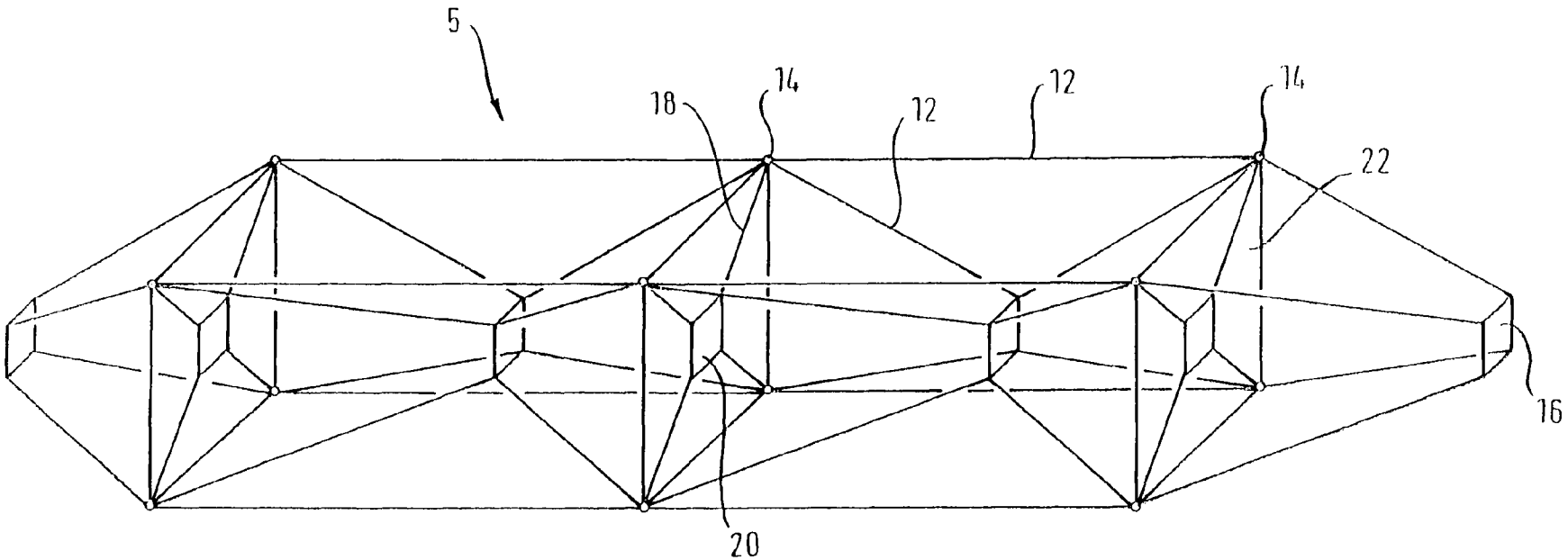
Figure 4:
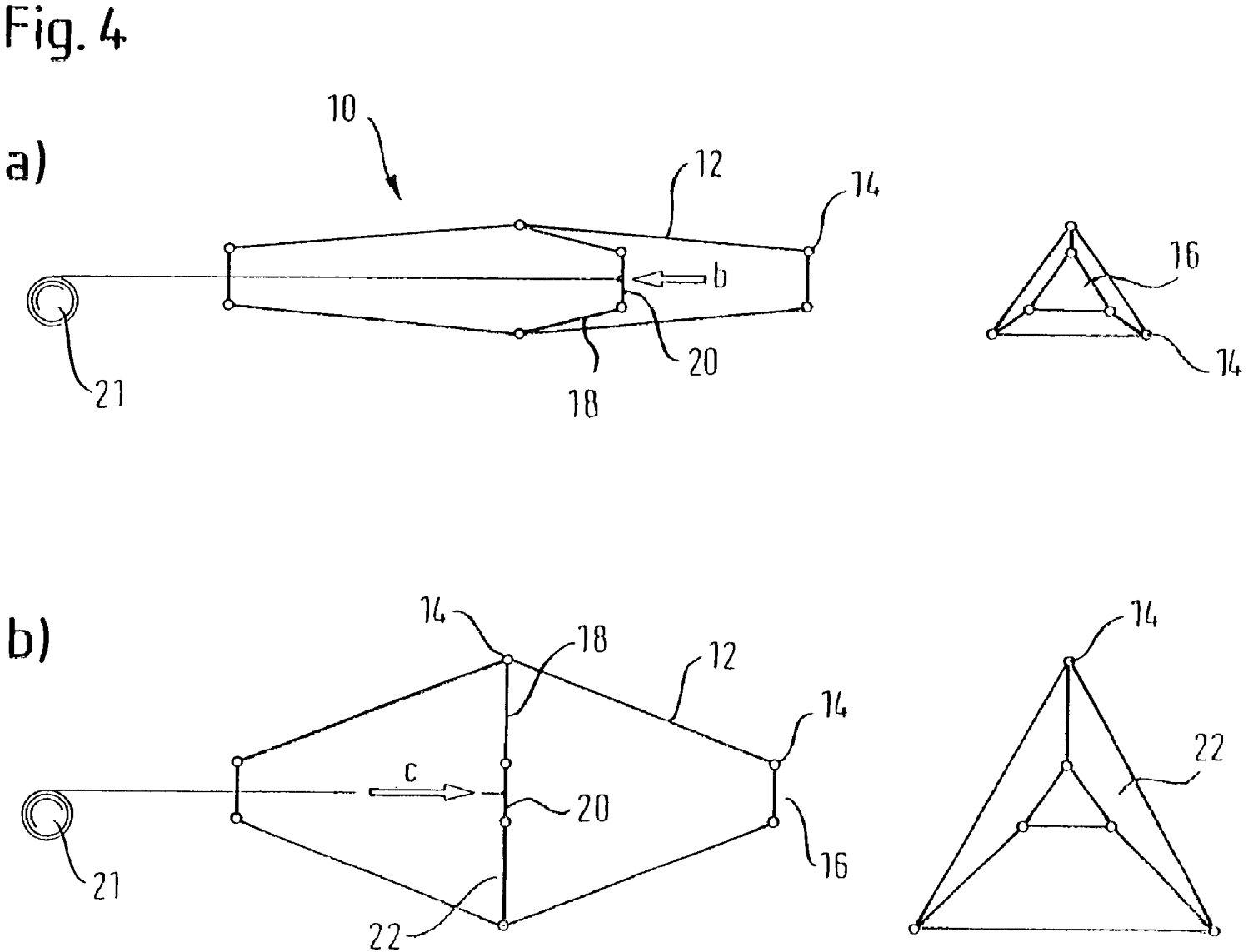
Figure 5:
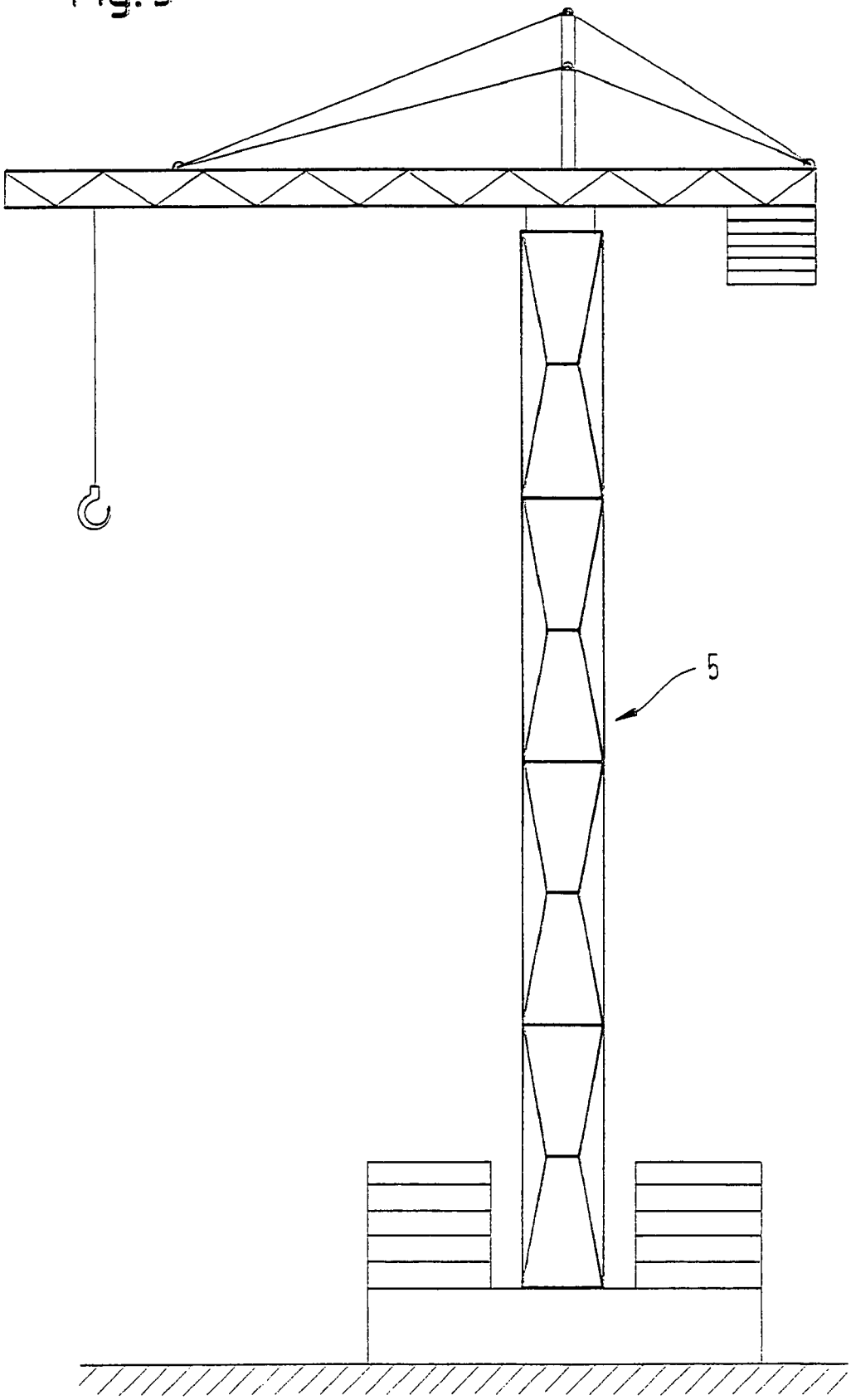
Figure 6:
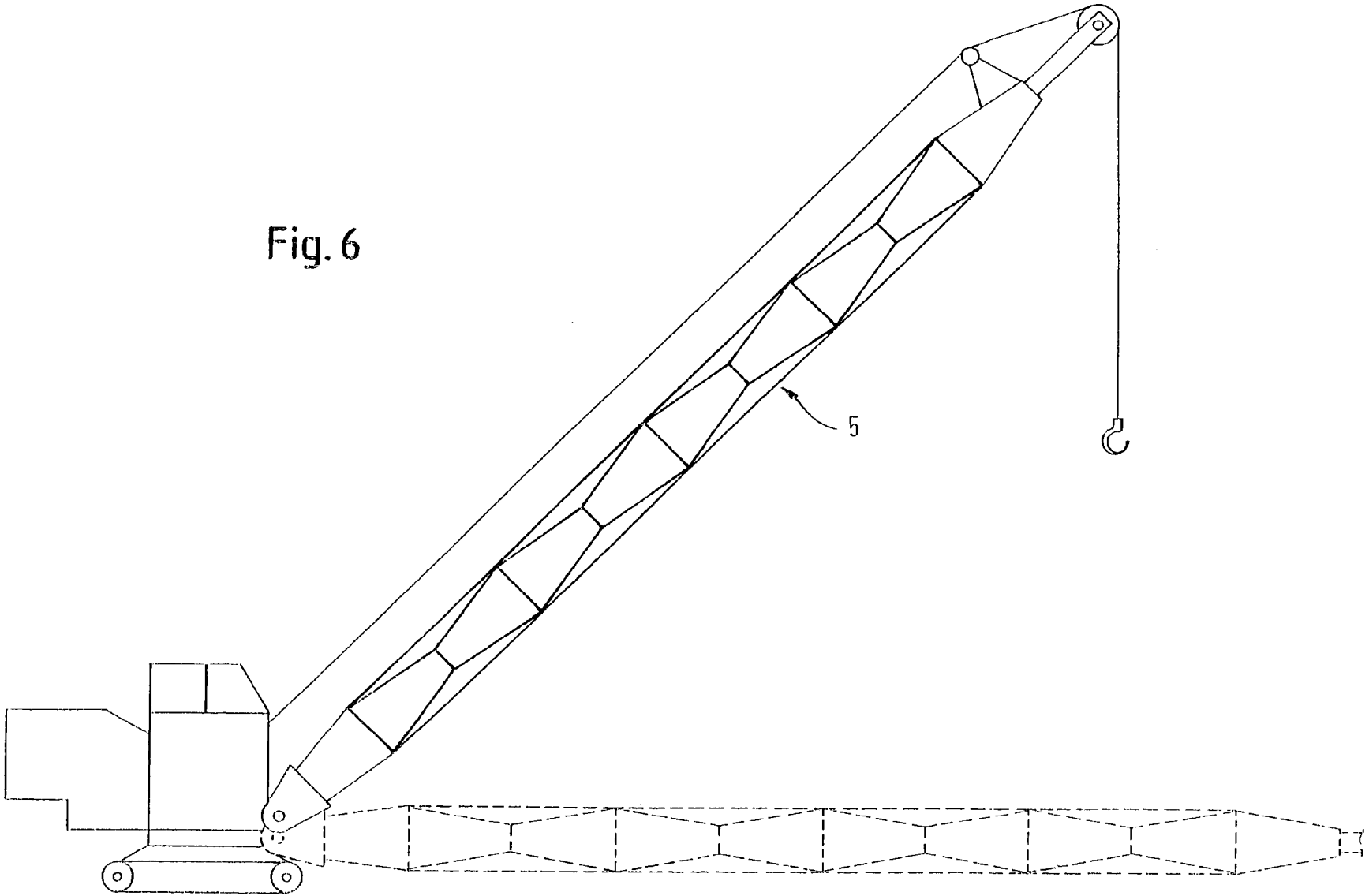

Further features, details and advantages of the invention result from the embodiments shown in the drawing. There are shown:

FIG. 1: schematically, a first structure of the lattice support structure in three stages during the deployment;

FIG. 2: schematically, the spread-apart first structure and corresponding lattice rods for the bracing of the first structure in the state not yet employed;

FIG. 3: the erected second structure of the lattice support structure;

FIG. 4: the first structure of a lattice support structure in accordance with another embodiment variant; and FIGS. 5 and 6: lattice support structures in corresponding application examples.

A first structure 10 of a lattice support structure is shown in three stations in FIG. 1, with the design of the first structure 10 of the lattice support structure being shown in FIG. 1*a*. Lattice rods 12 are interconnected there by means of articulation points 14 so that they bound an elongated column shape square in cross-section. In FIG. 1*a*, they have a small cross-section 15 extending substantially constantly over their length. It is shown in FIGS. 1*b* and *c* how the middle region of the first structure 10 is spread apart in the respective arrow direction a. Inner struts 18 and 20 serve this purpose which are likewise interconnected in an articulated manner and which can be spread apart in the arrow direction b, for example, via a winch 21 indicated here in the FIGS. 1*a* to *c*. The maximally spread apart position of the middle region results from FIG. 1*c* in accordance with which a substantially truncated double pyramid shape results which in each case tapers toward the free ends. The free ends here each have a cross-section 16, whereas the maximally spread-apart cross-section as cross-section 22 here has a substantially larger cross-sectional shape. The struts interconnected in an articulated manner in the inner region of the first structure 10 comprise four cross-struts 18 and a middle core region 20 which comprises four struts forming a square, with this square having the same cross-section as the respective end regions of the first structure. To fold together the first structure in accordance with FIG. 1*c*, a force is exerted in the direction c onto the inner strut structure 18, 20 so that the total articulated lattice structure is folded together to take up approximately the position in accordance with FIG. 1*a*.

To the extent the first structure of the lattice support structure is spread apart in accordance with FIG. 1*c*, a plurality of such structures 10 are connected to one another and are interconnected via additional lattice rods 24 and 26, which engage in the region of the spread-apart cross-sections, to form a stable second structure.

As a result, a lattice support structure 5 such as is shown in FIG. 3 results for the functional position. It has a cross-section 22. A similar lattice support structure is shown in FIG. 4 which only differs from that in accordance with FIGS. 1 to 3 in that here the cross-section is not square, but triangular.

In the embodiment in accordance with FIG. 4, the comparable parts to the parts of the embodiment shown in FIGS. 1 to 3 are marked with the same reference numerals.

A lattice support structure 5 is shown in FIG. 5 which here represents the support structure of a revolving tower crane in the assembled functional position. In FIG. 6, the support structure 5 is shown in the functional position and here forms the boom of a cable excavator.

The invention claimed is:

1. A lattice support structure comprising lattice rods interconnected in an articulated manner, said lattice support structure including a first structure having a first configuration expandable into a second configuration, said first configuration having a reduced cross-section relative to the second configuration, said first configuration operatively configured to be spread apart into the second configuration, said second configuration defined by a truncated double pyramid structure having a polygonal cross-section at its free ends which tapers from a maximally spread-apart cross-section to the polygonal cross-section toward its free ends; wherein a plurality of first structures are configured to be joined together by additional interconnecting lattice rods to form a second structure, with the additional lattice rods engaging at corner points of the spread-apart cross-sections.

2. A lattice support structure in accordance with claim 1, characterized in that its cross-section is triangular or rectangular.

3. A lattice support structure in accordance with claim 1, characterized in that, in the region of the cross-sections which can be spread apart, there are struts which are interconnected in an articulated manner and via which they can be spread apart and folded together.

4. A lattice support structure in accordance with claim 3, characterized in that the struts interconnected in an articulated manner have a core region which corresponds to the cross-section of the folded-together first structure and articulated struts extend from the corners of said core region to the corners of the cross-sections which can be spread apart.

* * * * *